US012629562B2

(12) United States Patent
Kwon

(10) Patent No.: US 12,629,562 B2
(45) Date of Patent: May 19, 2026

(54) WEIGHT TRAINING SYSTEM INTUITIVELY DISPLAYING QUANTITY OF MOTION

(71) Applicant: Sangeun Kwon, Daegu (KR)

(72) Inventor: Sangeun Kwon, Daegu (KR)

( * ) Notice: Subject to any disclaimer, the term of this patent is extended or adjusted under 35 U.S.C. 154(b) by 132 days.

(21) Appl. No.: 18/807,325

(22) Filed: Aug. 16, 2024

(65) Prior Publication Data

US 2024/0424347 A1 Dec. 26, 2024

Related U.S. Application Data

(63) Continuation of application No. PCT/KR2022/011274, filed on Aug. 1, 2022.

(30) Foreign Application Priority Data

Feb. 17, 2022 (KR) ..... 10-2022-0020716

(51) Int. Cl.
*A63B 24/00* (2006.01)
*A63B 71/06* (2006.01)

(52) U.S. Cl.
CPC ..... *A63B 24/0075* (2013.01); *A63B 71/0622* (2013.01); *A63B 2225/20* (2013.01)

(58) Field of Classification Search
CPC ..... A63B 24/0075; A63B 71/0622; A63B 2225/20; A63B 24/00; A63B 71/06; G16H 10/60; G16H 20/30
See application file for complete search history.

(56) References Cited

FOREIGN PATENT DOCUMENTS

| | | | | |
|---|---|---|---|---|
| DE | 202006021114 U1 * | 9/2012 | ..... | A63B 21/0628 |
| JP | 2002-078838 A | 3/2002 | | |
| KR | 10-2002-0068321 A | 8/2002 | | |
| KR | 2013-104977 A | 9/2013 | | |
| KR | 10-2018-0004928 A | 1/2018 | | |
| KR | 20180000812 A | 1/2018 | | |
| KR | 10-2261228 B1 | 6/2021 | | |

OTHER PUBLICATIONS

Reddit user vdnvn_goheavy, downloaded @ https://www.reddit.com/r/weightlifting/comments/at0c3t/what_do_you_track_and_how_do_you_visualize_your/, published on Feb. 21, 2019 (Year: 2019).*
International Search Report for PCT/KR2022/011274 Issued on Nov. 11, 2022.

* cited by examiner

*Primary Examiner* — Yingchun He
(74) *Attorney, Agent, or Firm* — NKL LAW; Jae Youn Kim

(57) ABSTRACT

Disclosed is a weight training system intuitively displaying the quantity of motion. The weight training system disclosed herein comprises: a user terminal which transmits and receives data by being connected to a motion server via a network and transmits an inputted quantity of motion to the motion server; and the motion server which transmits and receives data by being connected to the user terminal via the network and has an exercise volume display unit which displays, in the form of a bar graph, the quality of motion of the user received.

3 Claims, 5 Drawing Sheets

WEIGHT TRAINING SYSTEM INTUITIVELY DISPLAYING QUANTITY OF MOTION

The present disclosure relates to a weight training system intuitively displaying exercise volume and, more particularly, to a weight training system intuitively displaying exercise volume, in which the weight of a weighted object for each set for a corresponding exercise type is adjusted in conjunction with the color and width of a bar on a bar graph to be more easily identified, and the maximum length of the bar is designated to be different on the bar graph for each section for the number of exercise repetitions according to an exercise purpose so that the exercise purpose is identified only by the maximum length of the bar in the bar graph.

BACKGROUND

As interest in exercise grows and online systems become more widespread, services that provide exercise coaching online are becoming more common.

These online exercise management systems present each exercise method and systematically record and present the exercise volume of a user.

Weight training typically involves repeating a predetermined movement a predetermined number of times by using a weighted object. Accordingly, in order to record the exercise volume for weight training, an exercise type name, the weight of a weighted object, and the number of exercise repetitions for each set are required to be recorded.

In conventional exercise management systems, exercise volume for weight training was mainly expressed numerically.

This caused a problem that exercise volume was not intuitively understood by a user.

Therefore, there is a need to present a new type of exercise volume display method that allows a user to more intuitively understand exercise volume.

SUMMARY

The present disclosure has been proposed to solve the problems described above, and is intended to allow the weight of a weighted object for each set for a corresponding exercise type to be adjusted in conjunction with the color and width of a bar on a bar graph so as to be more easily identified.

In addition, the present disclosure is intended to designate the maximum length of the bar to be different on the bar graph for each section for the number of exercise repetitions according to an exercise purpose so that the exercise purpose is identified only by the maximum length of the bar in the bar graph.

The present invention provides a weight training system intuitively displaying exercise volume of a user, the weight training system including: a user terminal that transmits and receives data by being connected to an exercise server through a network and transmits input volume of exercise to the exercise server; and the exercise server provided with an exercise volume display unit that transmits and receives data by being connected to the user terminal through the network and displays, in a form of a bar graph, the exercise volume of a user received.

In addition, the exercise volume display unit of the present disclosure may include:

an exercise volume data storage module that stores weight of a weighted object and a number of exercise repetitions for each set for a type of the corresponding exercise received from the user terminal; and a weighted object weight display module that adjusts and displays a color and a width of a bar on the bar graph according to the weight of the weighted object stored in the exercise volume data storage module, wherein the weighted object weight display module may allow the weight of the weighted object to be adjusted in conjunction with the color and the width of the bar on the bar graph to be easily identified.

In addition, the exercise volume display unit of the present disclosure may further include:

an exercise repetitions display module that adjusts and displays a length of the bar on the bar graph according to the number of exercise repetitions for each set.

In addition, in the exercise repetitions display module of the present disclosure, after the number of exercise repetitions is categorized into a muscular strength improvement section, a muscular hypertrophy section, and a muscular endurance section according to an exercise purpose, the maximum length of the bar may be designated to be different on the bar graph for each section for the number of exercise repetitions according to the exercise purpose so that the exercise purpose is identified only by the maximum length of the bar in the bar graph.

According to the weight training system of the present disclosure, the weight of a weighted object for each set for a corresponding exercise type is adjusted in conjunction with the color and width of a bar on the bar graph, thereby making identification easier.

In addition, according to the present disclosure, the maximum length of the bar is designated to be different on the bar graph for each section for the number of exercise repetitions according to the exercise purpose, thereby enabling the identification of the exercise purpose only by the maximum length of the bar in the bar graph.

In addition to the effects described above, the specific effects of the present disclosure are described together with specific details for implementing the present disclosure below.

DETAILED DESCRIPTION OF EXEMPLARY EMBODIMENTS

Figure 1:
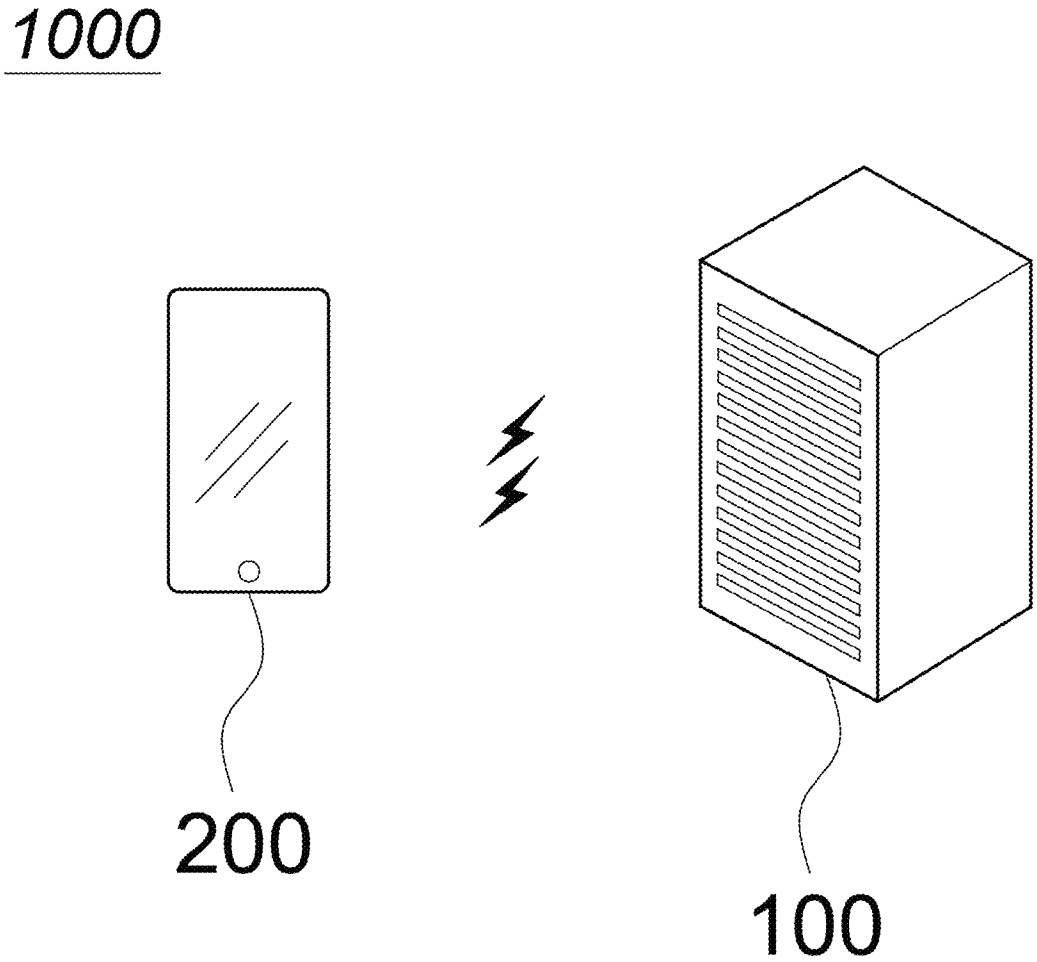
FIG. 1 is a view illustrating the configuration of a weight training system according to the present disclosure.

Hereinafter, an embodiment of the present document will be described with reference to the accompanying drawings. However, this is not intended to limit the technology described in this document to a specific embodiment, and it should be understood that various modifications, equivalents, and/or alternatives of the embodiment of this document are included. In connection with the description of the drawings, like reference numerals may be used for like components.

In addition, expressions such as "first" and "second" used in this document may modify various elements regardless of order and/or importance, and are used only to distinguish one element from another element but do not limit the corresponding components. For example, "first part" and "second part" may represent different parts regardless of order or importance. For example, without departing from the scope of the claims described in this document, the first component may be named as the second component, and similarly, the second component may also be named as the first component.

In addition, terms used in this document are used only to describe a specific embodiment, and may not be intended to limit the scope of other embodiments. A singular expression may include a plural expression unless the context clearly dictates otherwise. Terms used herein, including technical or scientific terms, may have the same meanings as commonly understood by those skilled in the art described in this document. Among the terms used in this document, terms defined in a general dictionary may be interpreted to have the same or similar meaning as meaning in the context of the related art, and unless explicitly defined in this document, are not interpreted as deal or excessively formal meanings. In some cases, even terms defined in this document cannot be construed to exclude the embodiment of the present document.

Figure 2:
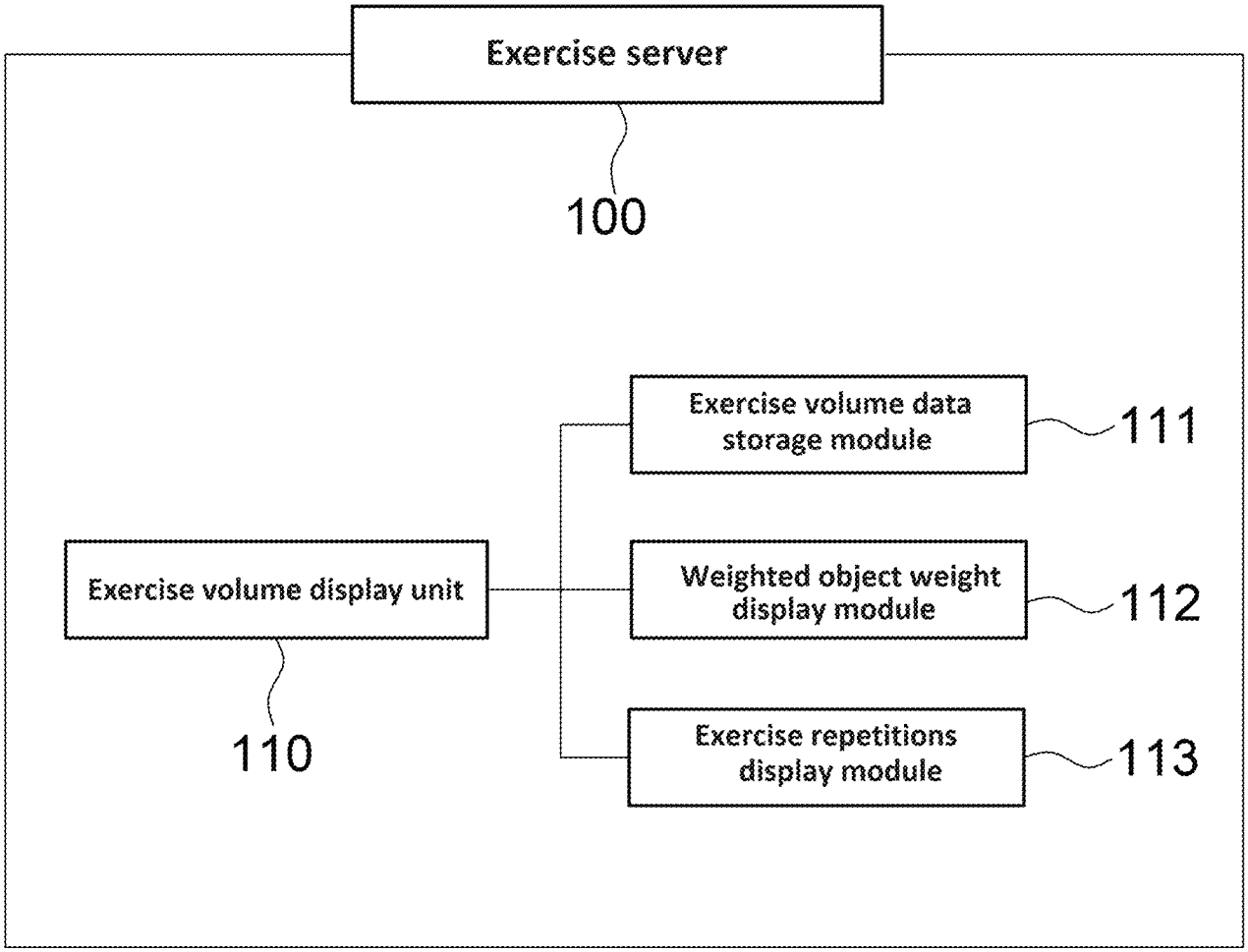
FIG. 2 is a block diagram of an exercise server according to the present disclosure.
Figure 3A:
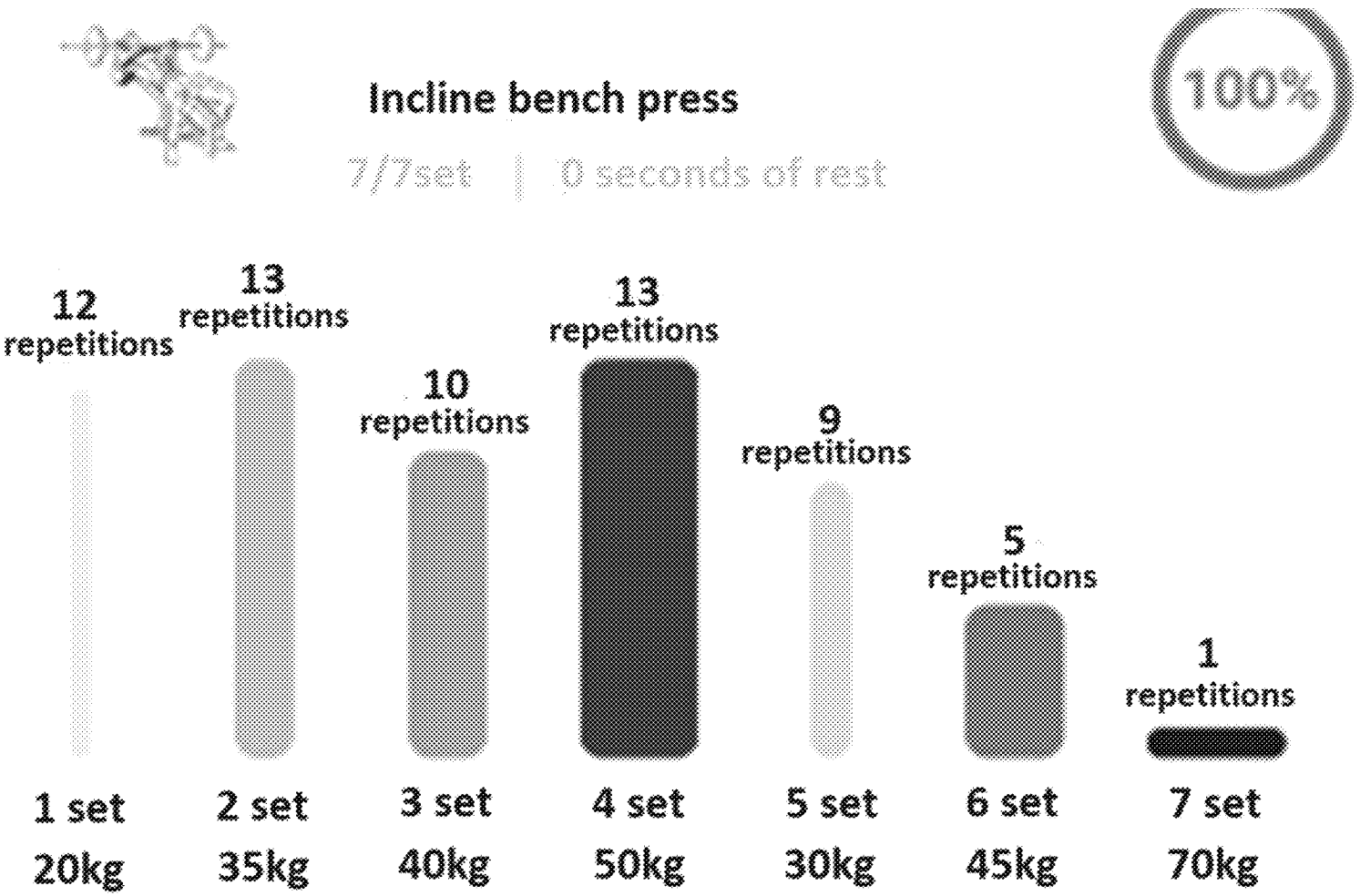
FIGS. 3A, 3B and 3C are views illustrating an example in which an exercise volume display unit according to the present disclosure displays exercise volume.
Figure 3B:
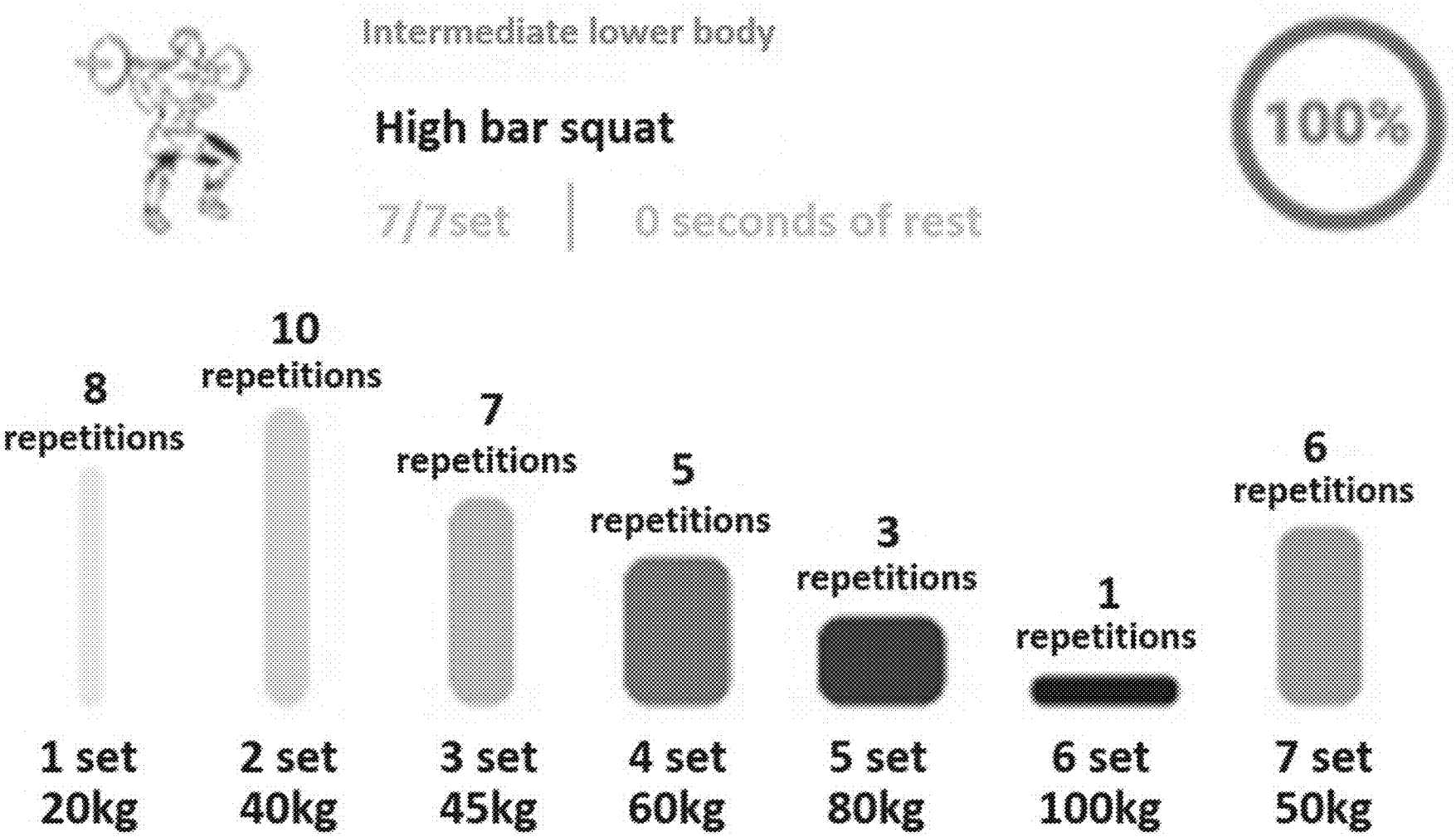
Figure 3C:
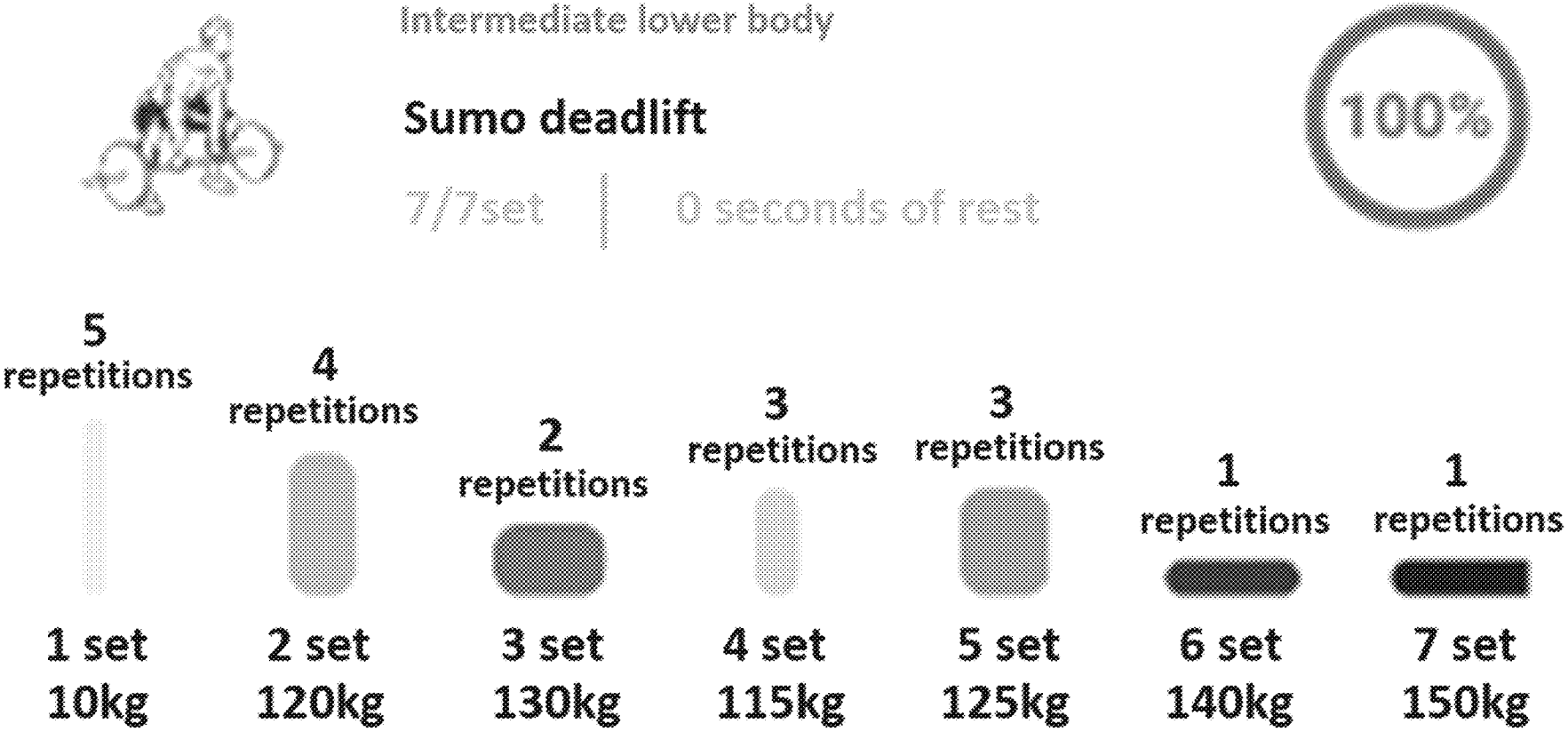

FIG. 1 is a view illustrating the configuration of a weight training system 1000 according to the present disclosure, FIG. 2 is a block diagram of an exercise server 100 according to the present disclosure, and FIGS. 3A, 3B and 3C are views illustrating an example in which an exercise volume display unit 110 according to the present disclosure displays exercise volume.

The following description will be made with referent to FIGS. 1 to 3.

In the present disclosure, a user-friendly bar graph is used to more intuitively display the exercise volume of weight training to a user, and bars are displayed to match the characteristics of the exercise volume of weight training.

To this end, the weight training system 1000 according to the present disclosure includes a user terminal 200, and the exercise server 100.

The user terminal 200 is configured to transmit and receives data by being connected to the exercise server 100 through a network and to transmit input exercise volume to the exercise server 100.

As the user terminal 200, various means, such as mobile phones and personal computers, etc., may be adopted.

The exercise server 100 is provided with the exercise volume display unit 110 that transmits and receives data by being connected to the user terminal 200 through the network and displays, in the form of the bar graph, the exercise volume of a user received.

As illustrated in FIG. 2, the exercise volume display unit 110 includes an exercise volume data storage module 111, a weighted object weight display module 112, and an exercise repetitions display module 113.

The exercise volume data storage module 111 is configured to store the weight of a weighted object and the number of exercise repetitions for each set for a corresponding exercise type received from the user terminal 200.

Weight training typically involves repeating a predetermined motion a predetermined number of times by using a weighted object. Accordingly, to record exercise volume for weight training, an exercise type name, the weight of the weighted object, and the number of exercise repetitions for each set are required to be recorded.

Accordingly, the exercise volume data storage module 111 stores the exercise type name, the weight of the weighted object, and the number of exercise repetitions for each set which are entered by a user.

In a typical bar graph, one physical quantity is represented by the length of a bar.

In the present disclosure, the representation method of the typical bar graph is avoided to enable a more intuitive understanding of exercise volume.

To this end, the weighted object weight display module 112 adjusts and displays the color and width of a bar on the bar graph according to the weight of the weighted object stored in the exercise volume data storage module 111.

For example, as the weight of the weighted object increases, the color of the bar is represented to be darker and the width of the bar is represented to be thicker.

That is, the weighted object weight display module 112 allows the weight of the weighted object to be adjusted in conjunction with the color and width of the bar on the bar graph to be more easily identified.

Meanwhile, the purpose of doing a corresponding exercise in weight training is usually divided into muscular strength improvement, muscular hypertrophy, and muscular endurance improvement.

Muscular strength refers to the power of a muscle that is generated by muscle contraction. When one end of a muscle is free and shortened tension thereof is constant, the strength of the muscle in a dynamic state in which a body part actually moves is called isotonic strength, and the strength of the muscle in a static state without movement of a body part, such as when applying force to a fixed object, is called isometric strength.

Muscular hypertrophy, or muscle building, refers to hypertrophy or increase in the size of skeletal muscle through growth in the size of muscle cells (myocytes).

Two factors, such as sarcoplasmic hypertrophy which focuses on increased storage of muscle glycogen, and myofibrillar hypertrophy which focuses more on increased size of myofibrils, contribute to muscular hypertrophy. Muscular hypertrophy is a major part of bodybuilding.

Muscular endurance is the ability of a muscle to continuously perform exercise (or work) at a constant speed and intensity. Muscular endurance is closely related to muscle blood flow and muscle oxygen uptake. In this regard, muscular strength refers to instantaneous tension that does not include the element of time and is related to a cross-sectional area or the number of active muscle fibers.

It is necessary to display an exercise purpose to be intuitively understood in the bar graph representing the exercise volume of weight training.

In weight training, the number of repetitions of a corresponding exercise for each exercise purpose is the lowest for muscular strength improvement, is followed by muscular hypertrophy, and is the highest for muscular endurance.

That is, the range of repetitions varies depending on an exercise purpose.

Considering these points, in the present disclosure, the range of standard exercise repetitions is set to be 5 or fewer for muscular strength, 6 to 11 for muscular hypertrophy, and 12 or more for muscular endurance.

The specific numerical values indicating the range of standard exercise repetitions may be changed in consideration of an exercise environment, etc.

For example, when performing an exercise called "a high bar squat", the number of exercise repetitions for the purpose of muscular strength improvement and the number of exercise repetitions for the purpose of muscular hypertrophy are different.

The exercise repetitions display module 113 is configured to adjust and display the length of the bar on the bar graph according to the number of exercise repetitions for each set.

In the present disclosure, it is considered that the number of exercise repetitions differs depending on an exercise purpose, and this is reflected in the exercise repetitions display module 113.

In the exercise repetitions display module 113, the range of standard exercise repetitions is set to be categorized into a muscular strength improvement section, a muscular hypertrophy section, and a muscular endurance section according to an exercise purpose.

In addition, the maximum length of the bar is designated to be different on the bar graph for each section for the number of exercise repetitions according to the exercise purpose.

For example, the maximum length of the bar may be set to be 4 centimeters for muscular strength improvement, 7 centimeters for muscular hypertrophy, and 10 centimeters for muscular endurance.

Referring to FIGS. 3A, 3B and 3C, it can be seen that a sumo deadlift is an exercise performed for the purpose of improving muscular strength, since the sumo deadlift has the maximum number of exercise repetitions of 5.

Accordingly, in the sumo deadlift, a bar length for the maximum number of exercise repetitions of 5 is set to be 4 centimeters. In addition, the number of exercise repetitions of 4 is represented to be 3.2 centimeters according to the ratio of 4 to 5.

Since the maximum number of exercise repetitions for the high bar squat is 10, it can be seen that this exercise is intended for muscular hypertrophy.

Accordingly, in the high bar squat, the bar length for the maximum number of exercise repetitions of 10 is set to be 7 centimeters. In addition, the number of exercise repetitions of 8 is represented to be 5.6 centimeters according to the ratio of 8 to 10.

As illustrated in FIGS. 3A, 3B and 3C, look at the maximum lengths of bars for three exercises, it can be intuitively seen that the sumo deadlift is aimed at muscular strength improvement, the high bar squat is aimed at muscular hypertrophy, and the incline bench press is aimed at muscular endurance improvement.

That is, by following exercise repetitions display method according to the present disclosure, an exercise purpose can be easily identified only by the maximum length of the bar in the bar graph.

The present disclosure relates to the weight training system 1000 intuitively displaying exercise volume and, more particularly, to the weight training system 1000 intuitively displaying exercise volume, in which the weight of a weighted object for each set for a corresponding exercise type is adjusted in conjunction with the color and width of a bar on a bar graph to be more easily identified, and the maximum length of the bar is designated to be different on the bar graph for each section for the number of exercise repetitions according to an exercise purpose so that the exercise purpose is identified only by the maximum length of the bar in the bar graph.

In the above, the exemplary embodiment of the present disclosure has been illustrated and described, but the present disclosure is not limited to the specific embodiment described above. Various modifications of the embodiment may be made by those of ordinary skill in the technical field to which the invention belongs without departing from the gist of the present disclosure claimed in the claims. These modified embodiments should not be individually understood from the technical spirit or prospect of the present disclosure.

The invention claimed is:

1. A weight training system displaying exercise volume of a user, the weight training system comprising:

a user terminal that transmits and receives data by being connected to an exercise server through a network and transmits exercise volume data to the exercise server; and the exercise server including an exercise volume display unit, the exercise server transmitting and receiving data by being connected to the user terminal through the network, the exercise volume display unit being configured to display, in a form of a bar graph, the exercise volume of the user received from the user terminal, wherein the exercise volume display unit includes:

an exercise volume data storage module configured to store a weight of a weighted object and a number of exercise repetitions for each set for a corresponding exercise type received from the user terminal; and a weighted object weight display module configured to adjust and display a color and a width of a bar on the bar graph according to the weight of the weighted object stored in the exercise volume data storage module, and wherein the weighted object weight display module allows the weight of the weighted object to be identified through the color and the width of the bar on the bar graph.

2. The weight training system of claim 1, wherein the exercise volume display unit further includes:

an exercise repetitions display module configured to adjust and display a length of the bar on the bar graph according to the number of exercise repetitions for each set.

3. The weight training system of claim 2, wherein the exercise repetitions display module sets a range of standard exercise repetitions and a maximum length of the bar in the bar graph to be different in each of a muscular strength improvement section, a muscular hypertrophy section, and a muscular endurance section, and wherein the bar length for the number of exercise repetitions for each set is displayed in proportion to a bar length for a maximum number of exercise repetitions in the corresponding exercise, so that a purpose of the corresponding exercise is identified by the maximum length of the bar in the bar graph.

* * * * *